US006655332B2

(12) United States Patent
Takenaka et al.

(10) Patent No.: US 6,655,332 B2
(45) Date of Patent: Dec. 2, 2003

(54) VALVE TIMING ADJUSTING APPARATUS

(75) Inventors: Akihiko Takenaka, Anjo (JP); Michio Adachi, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/369,710

(22) Filed: Feb. 21, 2003

(65) Prior Publication Data

US 2003/0177992 A1 Sep. 25, 2003

(30) Foreign Application Priority Data

Mar. 22, 2002 (JP) ..... 2002-081540

(51) Int. Cl.[7] ..... F01L 1/34

(52) U.S. Cl. ..... 123/90.17; 123/90.15; 123/90.31

(58) Field of Search ..... 123/90.17, 90.18, 123/90.15–90.16, 90.11–90.67

(56) References Cited

U.S. PATENT DOCUMENTS 3,861,243 A * 1/1975 Fleischer ..... 475/180
4,802,376 A * 2/1989 Stidworthy ..... 475/16
5,040,651 A * 8/1991 Hampton et al. ..... 192/45.1

FOREIGN PATENT DOCUMENTS

JP 10-153104 6/1998 ..... F01L/1/34

* cited by examiner

*Primary Examiner*—Thomas Denion
*Assistant Examiner*—Kyle Riddle
(74) *Attorney, Agent, or Firm*—Nixon & Vanderhye P.C.

(57) ABSTRACT

Upon transmission of a first torque from a first brake portion to a first eccentric shaft, the first eccentric shaft rotates in a retarding direction relative to a rotating member. This causes a first planetary gear to rotate in an advancing direction together with a first output shaft and a driven shaft. Upon transmission of a second torque from a second brake portion to a second eccentric shaft, the second eccentric shaft rotates in a retarding direction relative to the rotating member. This causes a second planetary gear to rotate in the advancing direction together with a second output shaft and the first eccentric shaft, relative to the rotating member, while maintaining rotation in the advancing direction relative to the second eccentric shaft and causes the first planetary gear to rotate in the retarding direction together with the first output shaft and the driven shaft relative to the rotating member.

10 Claims, 3 Drawing Sheets

VALVE TIMING ADJUSTING APPARATUS

CROSS REFERENCE TO RELATED APPLICATION

This application is based upon, claims the benefit of priority of, and incorporates by reference the contents of prior Japanese Patent Application No. 2002-81540 filed on Mar. 22, 2002.

BACKGROUND OF THE INVENTION

1. Field of the Invention

The present invention relates to a valve timing adjusting apparatus of an internal combustion engine (hereinafter, referred to simply as the engine) for adjusting an opening and closing timing (hereinafter, referred to as the valve timing) of at least one of an exhaust valve and an intake valve of the engine.

2. Description of the Related Art

Conventionally, a valve timing adjusting apparatus for adjusting valve timing of valves is known. Such an apparatus is provided to a transmission system that transmits driving torque of a crankshaft to a camshaft, where the crankshaft serves as an engine driving shaft and the camshaft serves as a driven shaft that opens and closes the exhaust valve or the intake valve of the engine. The valve timing adjusting apparatus adjusts the valve timing by changing a relative rotational phase (hereinafter, referred to simply as the phase) of the camshaft with respect to the crankshaft, thereby enhancing engine output and improving fuel consumption.

An apparatus that changes the phase of the camshaft through the use of oil pressure is one type of valve timing adjusting apparatus. In the case of using oil pressure, however, it is difficult to control a phase change of the camshaft with accuracy when the oil-pressure control conditions are strict, for example, during an operation under low-temperature circumstances, in a period immediately after engine start-up, etc.

In order to eliminate such an inconvenience, Japanese Patent Laid-Open Publication No. Hei. 10-153104 discloses a valve timing adjusting apparatus that changes the phase of the camshaft by making use of an electromagnetic force of an electromagnetic solenoid instead of using oil pressure. This apparatus, however, changes a phase by converting an electromagnetic-induced displacement of a piston member in the axial direction into rotational motions of the camshaft through a helical mechanism. Hence, when a larger width is given to a phase change, a large displacement in the axial direction is experienced by the piston member. This undesirably increases the size of the apparatus. Further, although this apparatus uses an electromagnetic force of the electromagnetic solenoid during an advancing operation that causes a phase change of the camshaft to an advancing side, it uses a biasing force of a biasing member by switching OFF the electromagnetic solenoid during a retarding operation that causes a phase change of the camshaft to a retarding side. This gives rise to a noticeable change in elastic modulus of the biasing member under low-temperature circumstances or the like, and the accuracy of the phase-change control is reduced. Also, because the phase change during the retarding operation depends on a biasing force of the biasing member, there is a limit to improving a response of the phase change. Moreover, energy is lost during the advancing operation for extra work needed to wind a helical spring used as the biasing member.

SUMMARY OF THE INVENTION

The invention therefore has an object to provide a valve timing adjusting apparatus of a compact size, capable of ensuring a width of a phase change of the driven shaft with respect to the driving shaft.

The invention has another object to provide a valve timing adjusting apparatus having an excellent phase change response of the driven shaft with respect to the driving shaft.

The invention has yet another object to provide a valve timing adjusting apparatus capable of constantly and accurately controlling a phase change of the driven shaft with respect to the driving shaft.

According to a valve timing adjusting apparatus of a first aspect of the invention, a first brake portion transmits a first torque to a first eccentric shaft that is off-center from a driven axis. The first eccentric shaft rotates around the driven axis in a direction opposite to the rotational direction of the driven axis. The first eccentric shaft then starts to rotate in a retarding direction relative with respect to a rotating member. Accordingly, a first planetary gear, which is supported on an outside wall of the first eccentric shaft to enable a relative rotation and rotates around the driven axis through engagement with a first internal gear of the rotating member, starts to rotate in an advancing direction together with a first output shaft and the driven shaft engaged therewith relative to the rotating member while rotating in the advancing direction relative to the first eccentric shaft. It is thus possible to change, while the first torque is transmitted, the phase of the driven shaft with respect to the rotating member, that is, the phase of the driven shaft with respect to the driving shaft that rotates the rotating member with driving torque, to an advancing side.

Also, according to the valve timing adjusting apparatus of the first aspect of the invention, a second brake portion transmits a second torque to a second eccentric shaft off-center from the driven axis and rotating around the driving axis, in a direction opposite to the rotational direction thereof. The second eccentric shaft then starts to rotate in the retarding direction relative to the rotating member. Accordingly, a second planetary gear, which is supported on an outside wall of the second eccentric shaft to enable relative rotation and rotation around the driven axis through engagement with a second internal gear of the rotating member, starts to rotate in the advancing direction. The second planetary gear rotates together with a second output shaft and the first eccentric shaft engaged therewith relative to the rotating member while maintaining rotation in the advancing direction relative to the second eccentric shaft. The first planetary gear thus starts to rotate in the retarding direction together with the first output shaft and the driven shaft relative to the rotating member while maintaining rotation in the retarding direction relative to the first eccentric shaft. It is thus possible to change, while the second torque is transmitted, the phase of the driven shaft with respect to the rotating member, that is, the phase of the driven shaft with respect to the driving shaft, to a retarding side.

As has been described, according to the valve timing adjusting apparatus of the first aspect of the invention, a displacement of each of the first and second eccentric shafts, the first and second planetary gears, and the first and second output shafts needed for a phase change of the driven shaft with respect to the driving shaft is obtained from a relative rotation around the driven axis with respect to the rotating member. For this reason, a larger quantity can be secured around the driven axis for the displacement of the foregoing components needed for a phase change of the driven shaft. It is thus possible to reduce the apparatus in size while ensuring a width of a phase change of the driven shaft.

According to a valve timing adjusting apparatus of a second aspect of the invention, one of the rotating member and the first output shaft is provided with a stopper slot that extends arc-wise around the driven axis. Further, the other one of the rotating member and the first output shaft is provided with a stopper protrusion that protrudes into the stopper slot and is allowed to rotate around the driven axis relative to the stopper slot. Hence, by allowing the stopper protrusion to abut against one or the other end portion of the stopper slot, it is possible to limit relative rotations of the first output shaft and the driven shaft with respect to the rotating member. In short, a length of the arc of the stopper slot can limit a width of a phase change of the driven shaft. It is thus possible to set a wider width to a phase change of the driven shaft by forming the stopper slot longer around the driven axis.

According to a valve timing adjusting apparatus of a third aspect of the invention, a first cyclone deceleration mechanism composed of the first internal gear, the first eccentric shaft, the first planetary gear, and the first output shaft, and a second cyclone deceleration mechanism composed of the second internal gear, the second eccentric shaft, the second planetary gear, and the second output shaft are provided adjacently to each other on the driven axis. Hence, the first cyclone deceleration mechanism and the second cyclone deceleration mechanism can be provided so as to superimpose in at least one of a direction parallel to and a direction perpendicular to the driven axis. It is thus possible to reduce the apparatus in size.

According to a valve timing adjusting apparatus of a fourth aspect of the invention, the first torque and the second torque are obtained by making use of electromagnetic forces induced from the first brake portion and the second brake portion, respectively. Hence, because an electromagnetic force is used in either case of causing a phase change of the driven shaft with respect to the driving shaft to the advancing side or to the retarding side, a response of the phase change can be improved. Moreover, by making use of an electromagnetic force that is hardly influenced by operating conditions, such as a surrounding temperature and an elapsed time since the start of the operation, it is possible to constantly and accurately control a phase change of the driven shaft.

According to a valve timing adjusting apparatus of a fifth aspect of the invention, each of the first eccentric shaft and the second eccentric shaft is provided with a function portion fixed thereto so as to rotate together, and each of the first brake portion and the second brake portion includes a solenoid. Also, each of the first torque and the second torque is obtained from a magnetic attraction force induced between the function portion fixed to corresponding one of the first eccentric shaft and the second eccentric shaft, and the solenoid in a switched-ON state included in corresponding one of the first brake portion and the second brake portion. It is thus possible to transmit the first and second torque with a relatively simple arrangement in a reliable manner.

According to a valve timing adjusting apparatus of a sixth aspect of the invention, the solenoid in each of the first brake portion and the second brake portion is provided so as to enable a displacement toward the function portion by the magnetic attraction force and so as to be attracted to the function portion. Because the solenoid is magnetically attracted to the function portion that rotates together with the first or second eccentric shaft, the first or second torque in large magnitude can be readily obtained. Further, each of the first brake portion and the second brake portion is provided with a biasing means for pushing the solenoid in a direction to move apart from the corresponding function portion. This arrangement makes it possible to stop transmission of the first or second torque by releasing the solenoid from the function portion with a biasing force of the biasing means while a magnetic attraction force is lowered by switching OFF the solenoid. As has been described, according to the valve timing adjusting apparatus of the sixth aspect of the invention, it is possible to allow each of the first torque and the second torque to act on their respective function portions only when needed in a sufficiently large magnitude.

According to a valve timing adjusting apparatus of a seventh aspect of the invention, the solenoid in the first brake portion and the solenoid in the second brake portion are formed into cylindrical shapes having different diameters, one of which is provided at an inner radius of the other. It is thus possible to reduce the apparatus in size.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description will describe one example of a preferred embodiment of the invention with reference to the accompanying drawings.

FIG. 1 through FIG. 4 show an example of a valve timing adjusting apparatus for an engine of the invention. A valve timing adjusting apparatus 10 of this example controls the valve timing of an illustrated intake valve of an engine 2.

Figure 2:
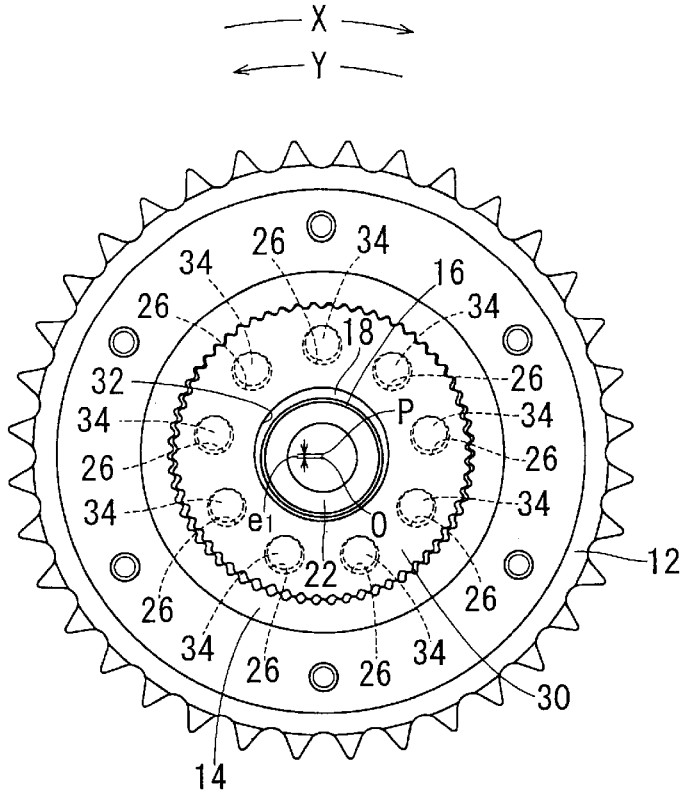
FIG. 2 is a cross-sectional view taken along the line II—II of FIG. 1.
Figure 3:
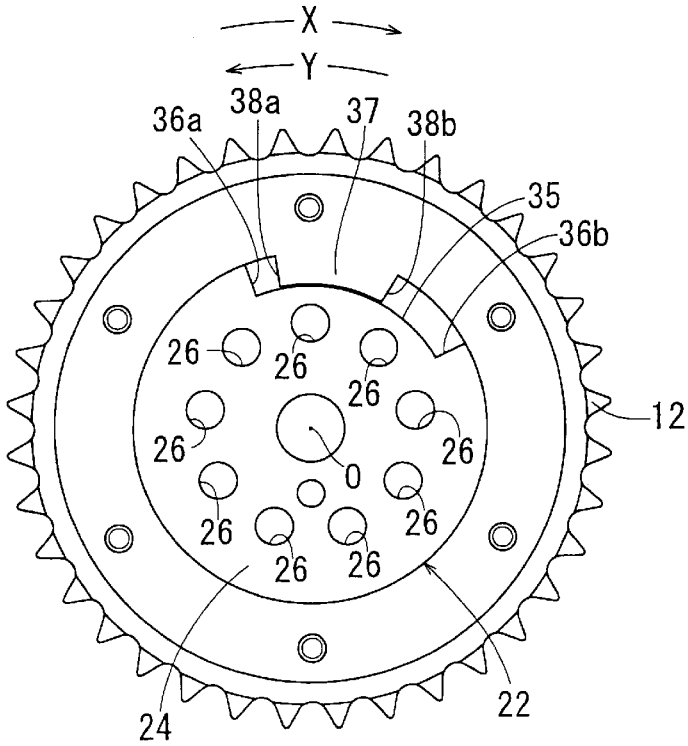
FIG. 3 is a cross-sectional view taken along the line III—III of FIG. 1.
Figure 4:
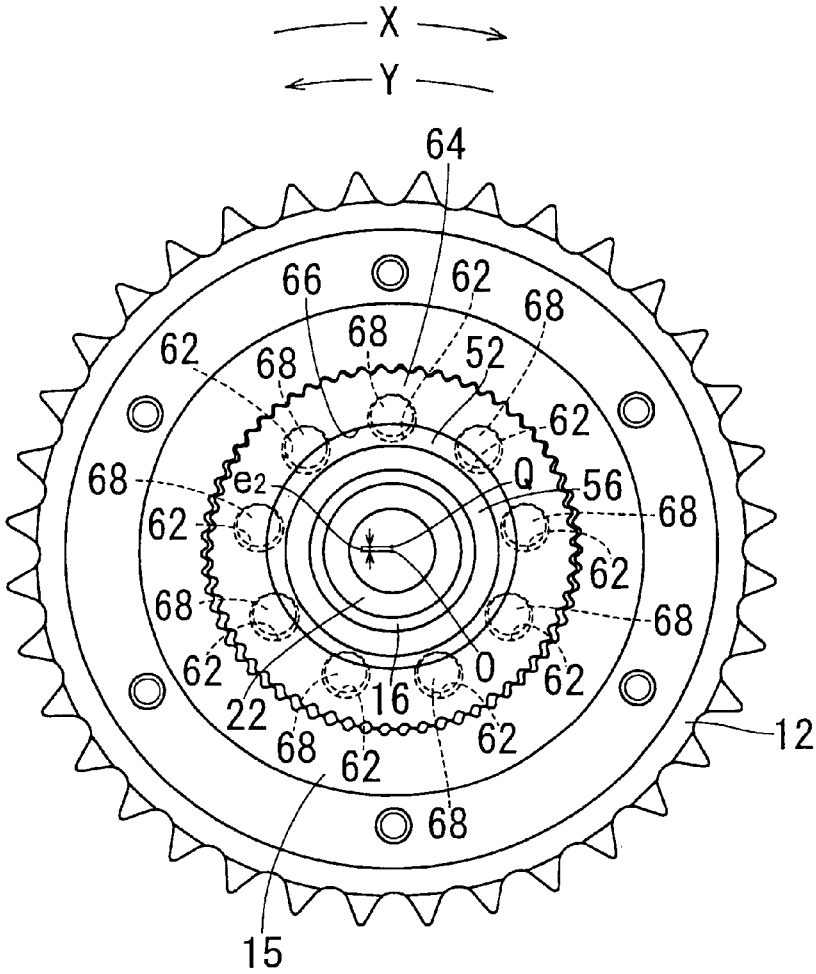
FIG. 4 is a cross-sectional view taken along the line IV—IV of FIG. 1.

The valve timing adjusting apparatus 10 is provided to a transmission system that transmits driving torque of an unillustrated crankshaft of the engine 2 to a camshaft 4 of the engine 2. As shown in FIG. 2 through FIG. 4, the camshaft 4 opens and closes the intake valve of the engine 2 by rotating around its axis (hereinafter, referred to as the cam axis) 0. The crankshaft and the camshaft 4 of the engine 2 form the driving shaft and the driven shaft, respectively. The valve timing adjusting apparatus 10 includes a housing 11, and the housing 11 is fixed to the engine 2 through a stay 6.

A sprocket 12 is supported on the outside walls of the camshaft 4 at one end portion 5 and of a first output shaft 22 at first end portion 23*a* to enable a relative rotation around the cam axis 0. A chain belt (not shown) is pulled across the sprocket 12 and the crankshaft of the engine 2. The sprocket 12 rotates around the cam axis 0 with driving torque of the crankshaft transmitted through the chain belt.

A first ring gear 14 and a second ring gear 15 are fixed to the inside wall of the sprocket 12. Each of the first ring gear 14 and the second ring gear 15 is an internal gear whose top curved surface is present at the inner radius of the bottom curved surface. The first ring gear 14 and the second ring gear 15 are aligned on the cam axis 0 in such a manner that their respective rotational center lines coincide with the cam axis 0. The first ring gear 14 and the second ring gear 15 are allowed to rotate around the cam axis 0 together with the sprocket 12. The first ring gear 14 and the second ring gear 15 form a first internal gear and a second internal gear, respectively, and the ring gears 14 and 15 and the sprocket 12 together form a rotating member.

A first transmission shaft 16 is supported on the outside wall of the first output shaft 22 at the second end portion 23b to enable a relative rotation around the cam axis 0. A first eccentric shaft 18, which is off-center with respect to the cam axis 0, is fixed to the outside wall of the first transmission shaft 16 at one end. Herein, $e_1$ of FIG. 2 indicates an eccentric quantity of an axis (hereinafter, referred to as the first eccentric axis) P of the first eccentric shaft 18 with respect to the cam axis 0. An annular plate of a first function portion 20 using the cam axis 0 as its rotational symmetry axis is provided at the other end of the first transmission shaft 16. The first transmission shaft 16, the first eccentric shaft 18, and the first function portion 20 are all allowed to rotate together around the cam axis 0.

The first end portion 23*a* of the first output shaft 22 has a lager diameter than the second end portion 23*b*, and the end portion 5 of the camshaft 4 is fit therein concentrically at the inner radius. The first output shaft 22 and the camshaft 4 are fixedly coupled to each other through a fixing bolt 25 screwed from the second end portion 23*b* side of the first output shaft 22. The first output shaft 22 is allowed to rotate around the cam axis 0 together with the camshaft 4.

A first planetary gear 30 is provided so as to enable a planetary motion at the outer radius of the center portion of the first output shaft 22. To be more specific, the first planetary gear 30 is an external gear whose top curved surface is present at the outer radius of the bottom curved surface. The radius of curvature of the top curved surface of the first planetary gear 30 is set smaller than the radius of curvature of the bottom curved surface of the first ring gear 14, and the number of teeth of the first planetary gear 30 is one less than that of the first ring gear 14. The first planetary gear 30 is provided with a fitting hole 32 having a circular cross section. The center line of the fitting hole 32 coincides with the rotational center line of the first planetary gear 30. The first eccentric shaft 18 is fit into the fitting hole 32 through a bearing (not shown), and the first planetary gear 30 is supported on the outside wall of the first eccentric shaft 18 to enable relative rotation around the first eccentric axis P. Here, the first eccentric axis P coincides with the rotational center line of the first planetary gear 30. When being supported in this manner, part of a plurality of teeth of the first planetary gear 30 engage with part of a plurality of teeth of the first ring gear 14.

When the first planetary gear 30 is not rotating around the first eccentric axis P relative to the first eccentric shaft 18, the first planetary gear 30, together with the sprocket 12 and the first eccentric shaft 18, rotates around the cam axis 0 while being engaged with the first ring gear 14 without changing the relative positional relationship. In a case where the first eccentric shaft 18 rotates around the cam axis 0 in a retarding direction Y relative to the sprocket 12 while the first planetary gear 30 is rotating as above, the first planetary gear 30, pressed against by the outside wall of the first eccentric shaft 18, is activated by the first ring gear 14 engaged with the first planetary gear 30. Then, the first planetary gear 30 starts to rotate around the first eccentric axis P in an advancing direction X relative to the first eccentric shaft 18. In this case, the first planetary gear 30 rotates around the cam axis 0 in the advancing direction X relative to the sprocket 12 while being engaged with part of the first ring gear 14. On the other hand, in a case where the first eccentric shaft 18 rotates around the cam axis 0 in the advancing direction X relative to the sprocket 12, the first planetary gear 30, pressed against by the outside wall of the first eccentric shaft 18, is activated by the first ring gear 14. Then, the first planetary gear 30 starts to rotate around the first eccentric axis P in the retarding direction Y relative to the first eccentric shaft 18. In this case, the first planetary gear 30 rotates around the cam axis 0 in the retarding direction Y relative to the sprocket 12 while being engaged with part of the first ring gear 14.

An annular plate of a first engagement portion 24, using the cam axis 0 as its rotational symmetry axis, is formed at the center portion of the first output shaft 22. The first engagement portion 24 is provided with engagement concave portions 26 at more than one point (in this example, nine points). The plurality of engagement concave portions 26 are provided at regular intervals around the cam axis 0. Each engagement concave portion 26 is a concave portion of the first engagement portion 24 recessed in the plate thickness direction and has a circular cross section, and its opening portion faces the first planetary gear 30. Meanwhile, the first planetary gear 30 is provided with engagement protrusions 34 corresponding to the engagement concave portions 26 at more than one point on the outside wall that directly opposes the first engagement portion 24. The plurality of engagement protrusions 34 are provided at regular intervals around the first eccentric axis P off-center from the cam axis 0 by an eccentric quantity $e_1$. Each engagement protrusion 34 is shaped like a pin protruding toward the first engagement portion 24 and has a circular cross section, and is inserted into the corresponding engagement concave portion 26. The outside diameter of each engagement protrusion 34 is set smaller than the inside diameter of the corresponding engagement concave portion 26.

When the first planetary gear 30 and the sprocket 12 are rotating together, the respective engagement protrusions 34 of the first planetary gear 30 engage with the inner walls of the corresponding engagement concave portions 26 of the first engagement portion 24, and press the inner walls in the rotational direction (herein, the advancing direction X). The first output shaft 22 and the camshaft 4 fixed thereto thus rotate around the cam axis 0 while maintaining a constant phase relation with respect to the sprocket 12. In a case where the first planetary gear 30 rotates in the advancing direction X relative to the sprocket 12 while the first output shaft 22 and the camshaft 4 are rotating as above, the respective engagement protrusions 34 further press the inner walls of the engagement concave portions 26 they are engaging with in the rotational direction. This causes the first output shaft 22 and the camshaft 4 to rotate around the cam axis 0 in the advancing direction X relative to the sprocket 12. On the other hand, in a case where the first planetary gear 30 rotates in the retarding direction Y relative to the sprocket 12, the respective engagement protrusions 34 press the inner walls of the engagement concave portions 26 they are engaging with in a direction opposite to the rotational direction. This causes the first output shaft 22 and the camshaft 4 to rotate around the cam axis 0 in the retarding direction Y relative to the sprocket 12.

Figure 1:
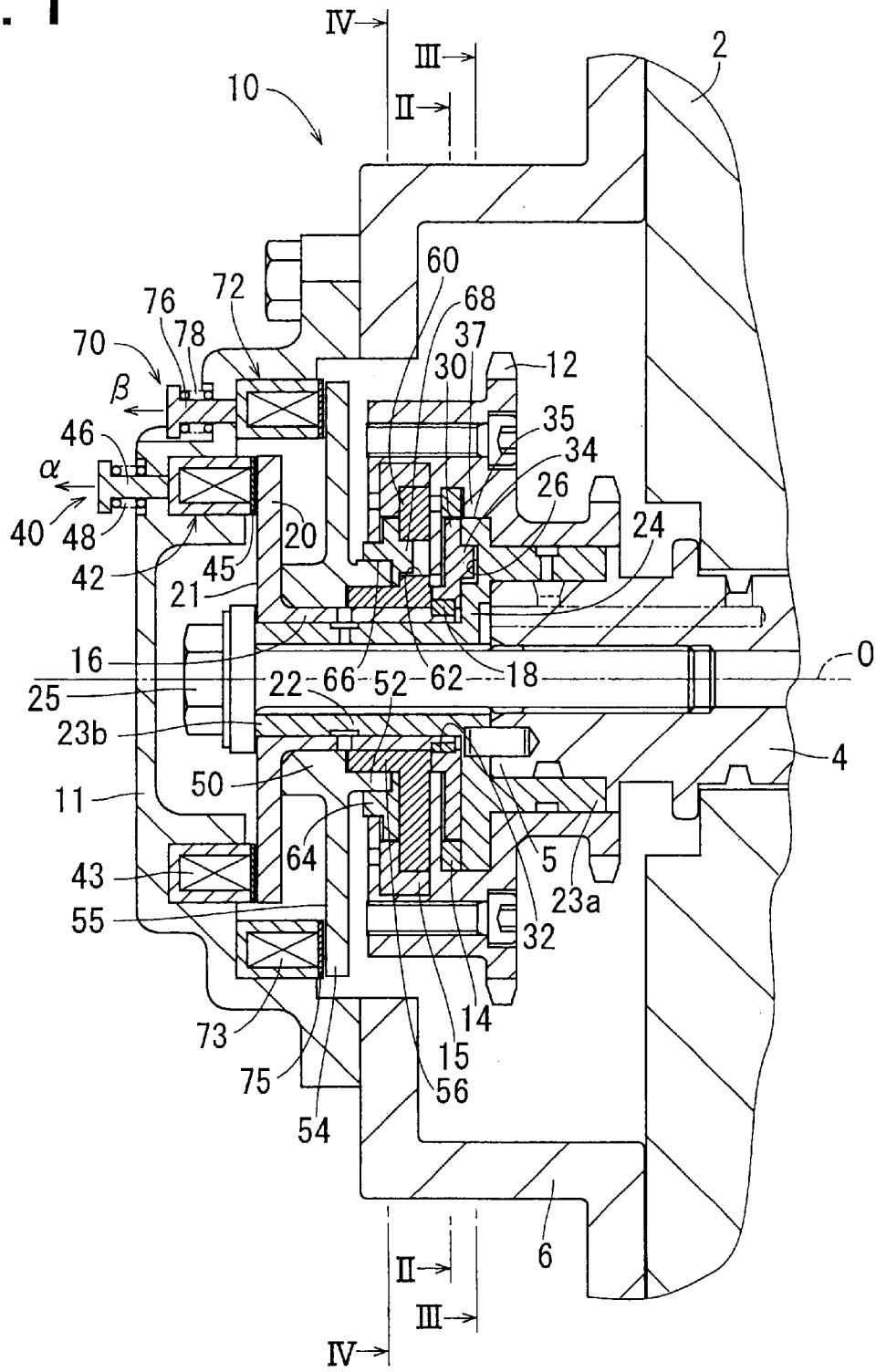
FIG. 1 is a cross-sectional view showing one example of a valve timing adjusting apparatus of the invention.

As shown in FIG. 1 and FIG. 3, a stopper slot 35 is formed in the outer edge portion of the first engagement portion 24 of the first output shaft 22. The stopper slot 35 extends arc-wise about the cam axis 0 in a certain length, and is opened toward the inner wall of the sprocket 12. A stopper protrusion 37 is formed as an integral part of the inner wall of the sprocket 12 facing the opening portion of the stopper slot 35. The stopper protrusion 37 protrudes into the stopper slot 35 and extends arc-wise about the cam axis 0 in a length shorter than that of the stopper slot 35.

When the first output shaft 22 rotates relative to the sprocket 12, the stopper protrusion 37 rotates relatively around the cam axis 0 within the stopper slot 35. In this instance, an end portion 38*a* of the stopper protrusion 37 on the retarding direction side abuts against an end portion 36*a* of the stopper slot 35 on the retarding direction side, thereby limiting a relative rotation of the first output shaft 22 in the advancing direction X. The limited position is the maximum advancing position of the first output shaft 22. Also, when an end portion 38*b* of the stopper protrusion 37 on the advancing direction side abuts against an end portion 36*b* of the stopper slot 35 on the advancing direction side, a relative rotation of the first output shaft 22 in the retarding direction Y is limited. The limited position is the maximum retarding position of the first output shaft 22. As has been described, in this example, the range of a relative rotation for the first output shaft 22 and hence the camshaft 4 is limited by the length of the arc of each of the stopper slot 35 and the stopper protrusion 37. For example, by giving a relatively long arc to the stopper slot 35 and a relatively short arc to the stopper protrusion 37, it is possible to secure a wider range of a relative rotation for the camshaft 4.

In this example, the first ring gear 14, the first transmission shaft 16, the first eccentric shaft 18, the first function portion 20, the first output shaft 22, the first planetary gear 30, etc. together form a first cyclone deceleration mechanism. A first brake portion 40 is provided in response to the first cyclone deceleration mechanism. The first brake portion 40 includes a first solenoid 42 and a first coil spring 48 as a biasing means.

The first solenoid 42 is formed into a cylindrical shape enclosing a wound coil 43, and is provided concentrically with the cam axis 0. The end surface at one end portion of the first solenoid 42 directly opposes a function surface 21 of the first function portion 20, and a frictional member 45 is fixed thereto. A first supporting shaft 46 protrudes toward the opposite side of the first function portion 20 which is fixed to the second end portion of the first solenoid 42. The first supporting shaft 46 is supported by the housing 11 to enable a displacement only in the axial direction. This arrangement inhibits the first solenoid 42 from rotating around the cam axis 0. A first coil spring 48 is disposed between the first supporting shaft 46 and the housing 11. The first coil spring 48 pushes the first supporting shaft 46 in a direction (direction a of FIG. 1) in which the first solenoid 42 moves apart from the first function portion 20.

The first solenoid 42 is excited when a current passes through the coil 43, and induces a magnetic attraction force across a space defined by the first solenoid 42 and the first function portion 20. The magnetic attraction force thus induced causes the first solenoid 42 to be displaced toward the first function portion 20 against a biasing force of the first coil spring 48, so that the first solenoid 42 is attracted to the first function portion 20 through the frictional member 45. In a case where the first solenoid 42 is attracted to the first function portion 20 that is rotating, friction between the first function portion 20 and the frictional member 45 produces a first torque in a direction (herein, the retarding direction Y) opposite to the rotational direction of the first function portion 20. Then, the first torque is transmitted to the first eccentric shaft 18 from the first function portion 20 through the first transmission shaft 16. Upon transmission of the first torque, the first eccentric shaft 18 starts to rotate around the cam axis 0 in the retarding direction Y relative to the sprocket 12. On the other hand, the first solenoid 42 in a switched-OFF state is pushed in the direction $\alpha$ of FIG. 1 by a biasing force of the first coil spring 48, and is thereby released from the first function portion 20 in a reliable manner.

A second transmission shaft 50 is supported on the outside wall of the first transmission shaft 16 at the center portion to enable relative rotation around the cam axis 0. A second eccentric shaft 52, which is off-center with respect to the cam axis 0, is formed at one end portion of the second transmission shaft 50. Herein, $e_2$ of FIG. 4 indicates an eccentric quantity of an axis (hereinafter, referred to as the second eccentric axis) Q of the second eccentric shaft 52 with respect to the cam axis 0. An annular plate of a second function portion 54 using the cam axis 0 as its rotational symmetry axis is provided to the center portion of the second transmission shaft 50. The second transmission shaft 50, the second eccentric shaft 52, and the second function portion 54 are allowed to rotate together around the cam axis 0.

A second output shaft 56 is fixedly coupled and concentric to the outside wall of the first transmission shaft 16 at the center portion. The second output shaft 56 is allowed to rotate around the cam axis 0 together with the first transmission shaft 16 and the first eccentric shaft 18.

A second planetary gear 64 is provided so as to enable planetary motion at the outer radius of the center portion of the second output shaft 56. To be more specific, the second planetary gear 64 is an external gear whose top curved surface is present at the outer radius of the bottom curved surface. The radius of curvature of the top curved surface of the second planetary gear 64 is set smaller than the radius of curvature of the bottom curved surface of the second ring gear 15, and the number of teeth of the second planetary gear 64 is one less than that of the second ring gear 15. The second planetary gear 64 is provided with a fitting hole 66 having a circular cross section. The center line of the fitting hole 66 coincides with the rotational center line of the second planetary gear 64. The second eccentric shaft 52 fits into the fitting hole 66 through a bearing (not shown), and the second planetary gear 64 is supported on the outside wall of the second eccentric shaft 52 to enable a relative rotation around the second eccentric axis Q. Here, the second eccentric axis Q coincides with the rotational center line of the second planetary gear 64. When being supported in this manner, part of a plurality of teeth of the second planetary gear 64 engages with part of a plurality of teeth of the second ring gear 15.

When the second planetary gear 64 is not rotating around the second eccentric axis Q relative to the second eccentric shaft 52, the second planetary gear 64, together with the sprocket 12 and the second eccentric shaft 52, rotates around the cam axis 0 while being engaged with the second ring gear 15 without changing the relative positional relationship. In a case where the second eccentric shaft 52 rotates around the cam axis 0 in the retarding direction Y relative to the sprocket 12 while the second planetary gear 64 is rotating as above, the second planetary gear 64, pressed against by the outside wall of the second eccentric shaft 52, is activated by the second ring gear 15 engaged with the second planetary gear 64. Then, the second planetary gear 64 starts to rotate around the second eccentric axis Q in the advancing direction X relative to the second eccentric shaft 52. In this case, the second planetary gear 64 rotates around the cam axis 0 in the advancing direction X relative to the sprocket 12 while being engaged with part of the second ring gear 15. Herein, an explanation is omitted as to a case where the second eccentric shaft 52 rotates around the cam axis 0 in the advancing direction X relative to the sprocket 12, because it is not necessary for the description of the invention.

An annular plate of a second engagement portion 60 using the cam axis 0 as its rotational symmetry axis is formed at one end portion of the second output shaft 56. The second engagement portion 60 is provided with engagement holes 62 at more than one point (in this example, nine points). The plurality of engagement holes 62 are provided at regular intervals around the cam axis 0. Each engagement hole 62 is a hole penetrating through the second engagement portion 60 in the plate thickness direction and having a circular cross section, and its one opening portion faces the second planetary gear 64. Meanwhile, the second planetary gear 64 is provided with engagement protrusions 68 corresponding to the engagement holes 62 at more than one point on the outside wall that directly opposes the second engagement portion 60. The plurality of engagement protrusions 68 are provided at regular intervals around the second eccentric axis Q off-center from the cam axis 0 by an eccentric quantity $e_2$. Each engagement protrusion 68 is shaped like a pin protruding toward the second engagement portion 60 and has a circular cross section, and is inserted into the corresponding engagement hole 62. The outside diameter of each engagement protrusion 68 is set smaller than the inside diameter of the corresponding engagement hole 62.

When the second planetary gear 64 and the sprocket 12 are rotating together, the respective engagement protrusions 68 of the second planetary gear 64 engage with the inner walls of the corresponding engagement holes 62 of the second engagement portion 60, and press the inner walls in the rotational direction (herein, the advancing direction X). The second output shaft 56 and the first eccentric shaft 18 coupled thereto through the first transmission shaft 16 thus rotate around the cam axis 0 while maintaining a constant phase relation with respect to the sprocket 12. In a case where the second planetary gear 64 rotates in the advancing direction X relative to the sprocket 12 while the second output shaft 56 and the first eccentric shaft 18 are rotating as above, the respective engagement protrusions 68 further press the inner walls of the engagement holes 62 they are engaging with in the rotational direction. This causes the second output shaft 56 and the first eccentric shaft 18 to rotate around the cam axis 0 in the advancing direction X relative to the sprocket 12.

In this example, the second ring gear 15, the second transmission shaft 50, the second eccentric shaft 52, the second function portion 54, the second output shaft 56, the second planetary gear 64, etc. together form a second cyclone deceleration mechanism. As shown in FIG. 1, the second cyclone deceleration mechanism and the first cyclone deceleration mechanism are provided adjacent to each other and superimposed in both a direction parallel to and a direction perpendicular to the cam axis 0. This arrangement reduces the valve timing adjusting apparatus 10 in size.

A second brake portion 70 is provided in response to the second cyclone deceleration mechanism. The second brake portion 70 includes a second solenoid 72 and a second coil spring 78 as a biasing means. The second solenoid 72 is formed into a cylindrical shape enclosing a wound coil 73, and is provided concentrically with the cam axis 0. The second solenoid 72 of this example has a larger diameter than the first solenoid 42, so that part of the first solenoid 42 is inserted at the inner radius of the second solenoid 72. This arrangement makes it possible to utilize a space at the inner radius of the second solenoid 72 effectively, and the valve timing adjusting apparatus 10 can be thus reduced in size.

The end surface at one end portion of the second solenoid 72 directly opposes a function surface 55 of the second function portion 54, and a frictional member 75 is fixed thereto. A second supporting shaft 76 protruding toward the opposite side of the second function portion 54 is fixed to the second end portion (far portion) of the second solenoid 72. The second supporting shaft 76 is supported by the housing 11 to enable a displacement only in the axial direction. This arrangement inhibits the second solenoid 72 from rotating around the cam axis 0. A second coil spring 78 is disposed between the second supporting shaft 76 and the housing 11. The second coil spring 78 pushes the second supporting shaft 76 in a direction (direction β of FIG. 1) in which the second solenoid 72 is moved apart from the second function portion 54.

The second solenoid 72 is excited when a current passes through the coil 73, and induces a magnetic attraction force across a space defined by the second solenoid 72 and the second function portion 54. The magnetic attraction force thus induced causes the second solenoid 72 to be displaced toward the second function portion 54 against a biasing force of the second coil spring 78 so that the second solenoid 72 is attracted to the second function portion 54 through the frictional member 75.

In a case where the second solenoid 72 is attracted to the second function portion 54 that is rotating, friction between the second function portion 54 and the frictional member 75 produces a second torque in a direction (herein, the retarding direction Y) opposite to the rotational direction of the second function portion 54. Then, the second torque is transmitted to the second eccentric shaft 52 from the second function portion 54 through the second transmission shaft 50. Upon transmission of the second torque, the second eccentric shaft 52 starts to rotate around the cam axis 0 in the retarding direction Y relative to the sprocket 12. On the other hand, the second solenoid 72 in a switched-OFF state is pushed in the direction β of FIG. 1 by a biasing force of the second coil spring 78, and is thereby reliably released from the second function portion 54.

An operation of the valve timing adjusting apparatus 10 will now be explained. When the crankshaft of the engine 2 is driven to rotate while the first solenoid 42 of the first brake portion 40 and the second solenoid 72 of the second brake portion 70 are both in a switched-OFF state, driving torque of the crankshaft is transmitted to the sprocket 12. The sprocket 12 and the first and second ring gears 14 and 15, fixed thereto, then start to rotate together. It should be noted that the phase of the sprocket 12 with respect to the crankshaft is maintained as a constant. In this instance, because the first solenoid 42 in the switched-OFF state is released from the first function portion 20, the first torque is not transmitted to the first eccentric shaft 18, and therefore, the first eccentric shaft 18 will not rotate relative to the sprocket 12. Hence, the first planetary gear 30 and the first eccentric shaft 18 start to rotate together with the sprocket 12 in association with a rotation of the sprocket 12. The first output shaft 22 and the camshaft 4 engaged with the first planetary gear 30 thus start to rotate at a certain phase with respect to the sprocket 12.

Also, while the sprocket 12 is rotating, the second solenoid 72 in the switched-OFF state is released from the second function portion 54, and the second torque is not transmitted to the second eccentric shaft 52. The second eccentric shaft 52, therefore, will not rotate relative to the sprocket 12. Hence, in this instance, the second planetary gear 64 and the second eccentric shaft 52 start to rotate together with the sprocket 12. The second output shaft 56 engaged with the second planetary gear 64 thus start to rotate together with the first transmission shaft 16 and the first eccentric shaft 18.

When the first solenoid 42 alone is switched ON while the sprocket 12 is rotating, the first solenoid 42 is magnetic attracted to the first function portion 20 that is rotating Then, the first torque, produced by friction between the frictional member 45 at the end portion of the first solenoid 42 and the first function portion 20, is transmitted to the first eccentric shaft 18. Upon receipt of the first torque, the first eccentric shaft 18 starts to rotate in the retarding direction Y relative to the sprocket 12 to decelerate. The first planetary gear 30 is activated by this relative rotation of the first eccentric shaft 18 in the retarding direction Y, and starts to rotate in the advancing direction X relative to the sprocket 12 while maintaining rotation in the advancing direction X relative to the first eccentric shaft 18. The first output shaft 22 and the camshaft 4, engaged with the first planetary gear 30, thus start to rotate in the advancing direction X relative to the sprocket 12 in order to accelerate. In other words, the phase of the camshaft 4 with respect to the sprocket 12 changes to the advancing side, and so does the phase of the camshaft 4 with respect to the crankshaft. The relative rotations of the first output shaft 22 and the camshaft 4 in the advancing direction X are limited by abutment of the stopper protrusion end portion 38*a* against the stopper slot end portion 36*a*.

On the other hand, when the second solenoid 72 alone is switched ON while the sprocket 12 is rotating, the second solenoid 72 is magnetically attracted to the second function portion 54 that is rotating, and the second torque produced friction between the frictional member 75 at the end portion of the second solenoid 72 and the second function portion 54 is transmitted to the second eccentric shaft 52. Upon receipt of the second torque, the second eccentric shaft 52 starts to rotate in the retarding direction Y relative to the sprocket 12 for deceleration. The second planetary gear 64 is activated by this relative rotation of the second eccentric shaft 52 in the retarding direction Y, and starts to rotate in the advancing direction X relative to the sprocket 12 while maintaining rotation in the advancing direction X relative to the second eccentric shaft 52. The second output shaft 56 and the first eccentric shaft 18 engaged with the second planetary gear 64 thus start to rotate in the advancing direction X relative to the sprocket 12 in order to accelerate.

Continuing, the first planetary gear 30 is activated by this relative rotation of the first eccentric shaft 18 in the advancing direction X, and starts to rotate in the retarding direction Y relative to the sprocket 12 while maintaining rotation in the retarding direction Y relative to the first eccentric shaft 18. The first output shaft 22 and the camshaft 4 engaged with the first planetary gear 30 thus start to rotate in the retarding direction Y relative to the sprocket 12 in order to decelerate. In other words, the phase of the camshaft 4 with respect to the sprocket 12 changes to the retarding side, and so does the phase of the camshaft 4 with respect to the crankshaft. It should be noted that the relative rotations of the first output shaft 22 and the camshaft 4 in the retarding direction Y are limited by abutment of the stopper protrusion end portion 38*b* against the stopper slot end portion 36*b*.

As has been described, according to the valve timing adjusting apparatus 10, a displacement of each component forming the first cyclone deceleration mechanism and the second cyclone deceleration mechanism is achieved by relative rotations around the cam axis 0 with respect to the sprocket 12. This makes it possible to secure a wider range of relative rotations around the cam axis 0 for the components forming the first and second cyclone deceleration mechanisms that determine a width of a phase change of the camshaft 4. It is thus possible to extend a width of a phase change of the camshaft 4 without increasing the apparatus in size.

Further, according to the valve timing adjusting apparatus 10, in either case of causing a phase change of the camshaft 4 to the advancing side or to the retarding side, the first torque and the second torque that induce the phase change are produced by making use of electromagnetic forces of the first solenoid 42 and the second solenoid 72, respectively. This improves a response of a phase change, that is, since the first and second solenoids 42 and 72 are switched ON until a phase change of the camshaft 4 takes place. Also, in general, the electromagnetic force is hardly influenced by operating conditions, such as the surrounding temperature of the apparatus and the elapsed time since the start of the operation. It is thus possible to control a phase change of the camshaft 4 with accuracy under low-temperature circumstances or during engine start-up.

Furthermore, according to the valve timing adjusting apparatus 10, in order to obtain the first torque and the second torque, the first solenoid 42 and the second solenoid 72 are attracted to the first function portion 20 and the second function portion 54, respectively, that are rotating. For this reason, torque in a large magnitude can be obtained from a small magnetic attraction force. It is thus possible not only to compactly form the first and second solenoid 42 and 72, but also to reduce a quantity of electricity.

In the example above, both the first brake portion 40 and the second brake portion 70 are arranged to obtain the first torque and the second torque, respectively, by making use of an electromagnetic force. However, it may be arranged in such a manner that at least one of the first torque and the second torque is obtained by, for example, making use of an elastic force of an elastic member. Also, in the example above, the first solenoid 42 and the second solenoid 72 are attracted to the first function portion 20 and the second function portion 54, respectively. However, they are not necessarily attracted to the corresponding function portions.

Moreover, the example above adopts an arrangement that the first eccentric shaft 18 is constantly coupled to the second output shaft 56 through the first transmission shaft 16. However, a clutch mechanism or the like such that can release the coupling may be provided somewhere between the first eccentric shaft 18 and the second output shaft 56.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A valve timing adjusting apparatus, provided to a transmission system that transmits driving torque of a driving shaft of an internal combustion engine to a driven shaft that opens and closes at least one of an exhaust valve and an intake valve, for adjusting opening and closing timing of at least one of said exhaust valve and said intake valve, said apparatus comprising:

a rotating member including a first internal gear and a second internal gear each using a driven axis, which is an axis of said driven shaft, as a rotational center line, and rotating around said driven axis with said driving torque of said driving shaft;

a first eccentric shaft off-center with respect to said driven axis and rotating around said driven axis in association with a rotation of said rotating member;

a first planetary gear supported on an outside wall of said first eccentric shaft to enable a relative rotation around a first eccentric axis, which is an axis of said first eccentric shaft, and rotating around said driven axis in association with a rotation of said rotating member through engagement with said first internal gear;

a first output shaft coupled to said driven shaft that rotates around said driven axis together with said driven shaft in association with a rotation of said first planetary gear through engagement with said first planetary gear;

a first brake portion for transmitting a first torque to said first eccentric shaft in a direction opposite to a rotational direction thereof;

a second eccentric shaft off-center with respect to said driven axis, which rotates around said driven axis in association with a rotation of said rotating member;

a second planetary gear supported on an outside wall of said second eccentric shaft to enable relative rotation around a second eccentric axis, which is an axis of said second eccentric shaft, which rotates around said driven axis in association with a rotation of said rotating member through engagement with said second internal gear;

a second output shaft coupled to said first eccentric shaft that rotates around said driven axis together with said first eccentric shaft in association with a rotation of said second planetary gear through engagement with said second planetary gear; and a second brake portion for transmitting a second torque to said second eccentric shaft in a direction opposite to a rotational direction thereof, wherein:

upon transmission of said first torque from said first brake portion to said first eccentric shaft while the first eccentric shaft rotates, said first eccentric shaft starts to rotate in a retarding direction relative to said rotating member, which causes said first planetary gear to rotate in an advancing direction together with said first output shaft and said driven shaft relative to said rotating member while maintaining rotation in the advancing direction relative to said first eccentric shaft; and upon transmission of said second torque from said second brake portion to said second eccentric shaft that is rotating, said second eccentric shaft starts to rotate in the retarding direction relative to said rotating member, which causes said second planetary gear to rotate in the advancing direction together with said second output shaft and said first eccentric shaft relative to said rotating member while maintaining rotation in the advancing direction relative to said second eccentric shaft, and causes said first planetary gear to rotate in the retarding direction together with said first output shaft and said driven shaft relative to said rotating member while maintaining rotation in the retarding direction relative to said first eccentric shaft.

2. The valve timing adjusting apparatus according to claim 1, wherein:

one of said rotating member and said first output shaft defines a stopper slot that extends arc-wise around said driven axis; and the other one of said rotating member and said first output shaft defines a stopper protrusion that protrudes into said stopper slot and is allowed to rotate around said driven axis relative to said stopper slot.

3. The valve timing adjusting apparatus according to claim 1, wherein a first cyclone deceleration mechanism composed of said first internal gear, said first eccentric shaft, said first planetary gear, and said first output shaft, and a second cyclone deceleration mechanism composed of said second internal gear, said second eccentric shaft, said second planetary gear, and said second output shaft are provided adjacently to each other on said driven axis.

4. The valve timing adjusting apparatus according to claim 2, wherein a first cyclone deceleration mechanism composed of said first internal gear, said first eccentric shaft, said first planetary gear, and said first output shaft, and a second cyclone deceleration mechanism composed of said second internal gear, said second eccentric shaft, said second planetary gear, and said second output shaft are provided adjacently to each other on said driven axis.

5. The valve timing adjusting apparatus according to claim 1, wherein said first torque and said second torque are obtained by making use of electromagnetic forces induced from said first brake portion and said second brake portion, respectively.

6. The valve timing adjusting apparatus according to claim 2, wherein said first torque and said second torque are obtained by making use of electromagnetic forces induced from said first brake portion and said second brake portion, respectively.

7. The valve timing adjusting apparatus according to claim 4, wherein said first torque and said second torque are obtained by making use of electromagnetic forces induced from said first brake portion and said second brake portion, respectively.

8. The valve timing adjusting apparatus according to claim 5, wherein:

each of said first eccentric shaft and said second eccentric shaft is provided with a function portion fixed thereto so as to rotate together;

each of said first brake portion and said second brake portion includes a solenoid; and each of said first torque and said second torque is obtained from a magnetic attraction force induced between said function portion fixed to one of said first eccentric shaft and said second eccentric shaft, and said solenoid in an ON state included in one of said first brake portion and said second brake portion.

9. The valve timing adjusting apparatus according to claim 8, wherein:

said solenoid in each of said first brake portion and said second brake portion is provided so as to enable a displacement toward said function portion by said magnetic attraction force and so as to be attracted to said function portion; and each of said first brake portion and said second brake portion is provided with a biasing means for pushing said solenoid in a direction to move apart from said function portion.

10. The valve timing adjusting apparatus according to claim 8, wherein said solenoid in said first brake portion and said solenoid in said second brake portion are formed into cylindrical shapes having different diameters, one of which is provided at an inner radius of the other.

* * * * *